US007726364B2

(12) United States Patent
Hayes et al.

(10) Patent No.: US 7,726,364 B2
(45) Date of Patent: Jun. 1, 2010

(54) ANTI-SMOKING DEVICE

(76) Inventors: Gerard Hayes, Greenfields, Drombanna, Limerick (IE); Alan Haymes, 8 Ridgeway Gardens, Redbridge, Essex (GB) IG4 5HJ ( * ) Notice: Subject to any disclaimer, the term of this patent is extended or adjusted under 35 U.S.C. 154(b) by 139 days.

(21) Appl. No.: 10/517,993

(22) PCT Filed: Jun. 16, 2003

(86) PCT No.: PCT/IE03/00091

§ 371 (c)(1),
(2), (4) Date: May 11, 2005

(87) PCT Pub. No.: WO03/105614

PCT Pub. Date: Dec. 24, 2003

(65) Prior Publication Data

US 2005/0224136 A1 Oct. 13, 2005

(30) Foreign Application Priority Data

Jun. 17, 2002 (IE) ..... 2002/0493

(51) Int. Cl.
*B65B 1/04* (2006.01)

(52) U.S. Cl. ..... 141/329; 131/270

(58) Field of Classification Search ..... 131/270; 141/67, 2, 18, 329

See application file for complete search history.

(56) References Cited

U.S. PATENT DOCUMENTS 2,333,049 A 10/1943 Shapiro
3,319,632 A * 5/1967 Burbig ..... 131/300
3,732,872 A 5/1973 Lakritz
3,733,010 A * 5/1973 Riccio ..... 222/635
3,859,999 A 1/1975 Ishikawa
4,420,100 A * 12/1983 Mueller ..... 222/205
4,563,178 A * 1/1986 Santeramo ..... 604/208
4,926,889 A * 5/1990 Brackett ..... 131/329
5,240,015 A * 8/1993 Rosen et al. ..... 131/335
5,261,572 A * 11/1993 Strater ..... 222/215
6,745,778 B2 * 6/2004 Grzonka et al. ..... 131/309

FOREIGN PATENT DOCUMENTS

FR 574411 7/1924
WO WO 81 03413 A 12/1981
WO WO 92 14371 A 9/1992

* cited by examiner

*Primary Examiner*—Steven O Douglas
(74) *Attorney, Agent, or Firm*—Rossi, Kimms & McDowell LLP

(57) ABSTRACT

A device for delivering a distributed zone of fluid for forming a wet impact barrier in a filter of a smoking product includes a container for holding the fluid, and a delivery mechanism for delivering the fluid from the container to the filter. The delivery mechanism can be a tube or needle of significantly lesser diameter than the diameter of the smoking product for placing a defined quantity of the fluid at a predetermined location within the smoking product, such as by injection through a side wall of the filter in the vicinity of the filter/tobacco boundary.

5 Claims, 5 Drawing Sheets

ANTI-SMOKING DEVICE

BACKGROUND OF THE INVENTION

1. Field of the Invention

This invention relates to the tobacco art, and more particularly, to a device for introducing a wetted impact barrier into a smoking article.

2. Description of the Prior Art

There have been attempts to design tar and nicotine reducing elements for tobacco smoke described in the prior art and several of these elements contain means for moistening or humidifying a porous filter. Typically, a frangible module containing water or an aqueous solution is embedded in the filter and the module is compressed to release the liquid before the filter is used. The moistened filter material in the element then exhibits an improved ability to remove primary tars, nicotine, and certain other volatiles from the smoke.

For example, in U.S. Pat. No. 3,884,246, to Eric E. Walker, a tobacco smoke filter element is comprised of a resilient, water impervious elongated tubular casing having a porous plug of filtering material disposed in each end of said casing. Opposed, mutually spaced, disc-like walls are disposed within said casing between said plugs, one wall within said casing between said plugs and one wall abutting the inner surface of each plug. Said walls define a chamber within the central portion of said casing and have at least one port in each wall. The device further includes at least one liquid containing module disposed within said chamber and extending between said walls, and said walls have at least one passage for allowing smoke through said filter element. Means carried by said element and co-operating between said module and at least one port in each of said walls direct liquid from said module through ports into said plugs responsive to compression of the external walls of said chamber, so that said plugs may act selectively as a dry filter, or, when said casing is compressed, as a filter moistened by said liquid.

In U.S. Pat. No. 3,428,049 to Leake et al., one or more of said modules are surrounded by a compressed filter material in the element. When the module is compressed, the liquid saturates the filter material, causing it to expand into the space occupied by the module. It is made as part of the cigarette, confined to the filter.

In U.S. Pat. No. 3,635,226 to Horsewell et al., a liquid-containing capsule is disposed between an absorbent plug adjacent the tobacco and a non-absorbent plug, such that when the capsule is compressed the liquid is released into the absorbent plug. U.S. Pat. No. 3,596,665 to Lundegard also describes a frangible, liquid-containing module disposed between two plugs. Compression of this module releases the liquid into both plugs for enhanced filtering.

In addition, many different liquids have been encapsulated within the filter mechanism to moisten the filters. Examples thereof are water, glycerin, and aqueous solutions or emulsions containing aromatic flavouring agents. These liquids act, in the filter, primarily to cool the smoke and to facilitate condensation of volatile components therein on the filter substrate.

The above mentioned filters describe smoke filters containing collapsible or frangible capsules filled with water or other liquids. Filter elements containing liquid pose a problem of retaining the liquid during storage, and those containing capsules or other containers of a liquid present within the filter structure cause a problem when the liquid is released, as the liquid holds the filter element in a collapsed state after pressure on the filter has been released.

The aforementioned prior filters lack the desired versatility necessary for widespread acceptance.

In the above mentioned products, the liquid products were incorporated inside the filter or made as an attachment to the filter.

U.S. Pat. Nos. 4,003,387, 4,046,153 and 3,797,644 are directed to a disposable cigarette holder made of plastics, which has a wet cotton filter on the inside. The wetness is effected by glycerin and water. The holder is attached to the cigarette which draws smoke into and over the wet cotton filter, held together by plastics casing, into the mouth, which causes the tar and nicotine in the smoke (total particulate matter) to adhere onto the fibre wet filter. This product is thus an attachment. Most smokers object to having a foreign object, such as a holder made of plastics, in their mouth.

As a practical matter, the processes of manufacturing and packaging cigarettes and the necessity for storing cigarettes for varying periods of time have proven to be affected because of damage to filters, drying out, or impact or disfiguring of the filter with moisture before being smoked.

Another example, in U.S. Pat. No. 3,319,632 to Henry Burbig, relates to a cigarette moistener device. In this device, the interior of the filter tip of a cigarette is moistened. The device is topped by a receptacle and is provided with a hollow needle extending axially thereof, the needle having a number of openings in the side thereof and the hollow needle extending into the moistener container. Where the moistener container is a squeeze bottle with a resilient side, the insertion of the filter into the receptacle and squeezing the sides of the moistener container will result in impregnating the inner part of the filter with moisture. The utilization of a hollow needle of greatly restricted diameter will meter the amount of moisture thus expressed on a single squeeze, to impregnate the interior of the cigarette filter with water.

U.S. Pat. No. 5,158,099 describes a wet impact barrier filter medium for a smoking article wherein the wet impact barrier is coated across the end of the filter substantially transverse of the smoking article. The wet impact barrier is applied in sufficient amount so as to reduce tar and nicotine produced by the products of combustion.

International Publication No. WO92/14371 corresponds to U.S. Pat. No. 5,240,015, which is a continuation-in-part of U.S. Pat. No. 5,158,099, and relates to a wetted impact barrier which is separate and in no way attached to or bound to cigarette filters until the wetted impact barrier is physically applied to create a wetted impact barrier at the top end surface of the cigarette filter where the smoke is drawn into the mouth. The publication also describes a kit and a method of application of said kit to a cigarette in order to reduce the tar and nicotine inhaled by the cigarette smoker.

FIGS. 1 to 4 of the present application correspond to FIGS. 2, 8, 9 and 5 respectively of International Publication No. WO 92/14371. In particular, FIG. 1 shows the free end at the top of the filter of the cigarette showing a square type recess 12 in the form of a well in the filter end face. The wetted surface designated by reference 13 represents an impact barrier formed at the top surface of the filter by application of a quantity of liquid to the recess 12. FIG. 2 illustrates a cross-shaped recess configuration 19 in the top surface 11 of the filter of a cigarette which is as yet untouched by any wet impact barrier. FIG. 3 represents a further end view showing a cigarette before a wetted impact barrier is applied to the top surface 11 of the filter. A circular recess 27 is in this case provided in the top surface 11 of the filter. FIG. 4 illustrates the impact-barrier forming kit described in International Publication WO 92/14371, said kit comprising a dispenser and instructions.

In the device disclosed in International Publication WO 92/14371, barrier-forming liquid is inserted into the filter by making a hole in the end of the filter and squeezing a prescribed number of drops into the hole. A hole which is substantial in size relative to the size of the filter is gouged out. When the recess is charged with barrier-forming liquid, this spreads out through and soaks into the filter material at and adjacent to the end surface, to define the wet impact barrier. However, this can engender problems. For example, when the fluid is put into the filter, some users may taste the fluid, which in turn has an adverse effect on the efficiency of the smoking deterrent programme. Such a feature is not very encouraging for a user who intends to quit smoking.

There is therefore a need for a more effective method for delivery of fluid to provide an impact barrier in a smoking article. The invention provides a method wherein the fluid is inserted into the side of the filter, preferably towards the base of the filter, near the tobacco, by piercing a small hole and injecting the fluid in from a cartridge or container. The barrier is thus established at a location spaced from or remote from the top or free end surface of the filter, which is received in the mouth. A diversity of further methods for establishing the barrier at a location remote from the free end face of the filter are provided by alternative embodiments of the invention.

A number of cigarette/cigar treatment devices are known in which injection type techniques are applied. International Publication No. WO 81/03413 discloses a device for use by a smoker to introduce treatment fluids into a cigar, cigarette, charge of pipe tobacco, or similar consumer unit of smoking tobacco. A dispenser for the fluid is held in an outer casing, which also supports a receiver for the tobacco. An injection needle is disposed centrally within the receiver for dispensing the treatment fluid throughout the tobacco. A series of intercommunicating passages within the unit conduct the fluid from the dispenser to the needle upon actuation of the dispenser.

U.S. Pat. No. 4,269,203 discloses a device for injecting an unpleasant odoriferous substance into cigarettes contained within a package. The arrangement includes a hollow carrying case with an upper chamber for receiving a package of cigarettes and a lower chamber which contains the odoriferous substance. Hollow needles are arranged to extend from the lower chamber into the upper chamber for penetration into the cigarettes. The arrangement provides for the injection of the unpleasant substance into a multiplicity of cigarettes by a single injection operation.

U.S. Pat. No. 3,732,872 provides an apparatus for uniformly distributing an additive solution throughout the length of a cigarette. A hinged block has a recessed cavity or cradle for holding a cigarette and is movably attached to one end of a track. A carriage provided with clamps for holding a syringe or additive reservoir is movably attached to the track in a position facing the hinged block. The syringe or reservoir has a needle and plunger. The carriage is moved forward so that syringe needle penetrates the length of the cigarette, with its tip positioned at the end of the cigarette opposite to that at which it entered. Injection of the additive solution is then effected.

U.S. Pat. No. 4,054,146 provides an arrangement for reducing the content of smoking bi-products, including nicotine and tar, and the smoke inhaled by a smoker. A perforator box is used to simultaneously perforate the paper covering the smoking end of all cigarettes in a pack. The full pack is placed in an open-sided box and a needle studded cover is pressed onto the box so that the needles perforate the cigarettes. When smoked, smoke from the perforated cigarettes contains a lower percentage of nicotine and tars. The needles serve to perforate only the side walls of the tobacco region of the cigarette. There is no perforation of the filter and neither is there is any injection of additive material.

The prior art additive or fluid injection means described do not provide for specific placement of an additive substance in a specific region of the smoking product, in particular the filter. The arrangements described are also particularly suited to the transfer of low viscosity substances and are not necessarily adapted for the convenient injection of more viscous or sticky type materials.

In regard to the specific precise placement of an additive substance, the present invention thus also meets the requirement of providing a method of inserting a barrier fluid into a filter-tip so that the fluid is dispersed at a position in the filter sufficiently distant from the end of the cigarette which is put into the mouth of the user as will minimise the risk of the user tasting the fluid. Ease of application of barrier-forming fluid and minimisation of the risk of tasting the fluid are thus provided by the invention and encourage use of the related smoking termination programme and adherence thereto by users.

BRIEF SUMMARY OF THE INVENTION

The invention provides a device for providing a distributed zone of fluid in a filter of a smoking article comprising:

(a) a container for a fluid which forms a wet impact barrier when inserted into a smoking article, and (b) a delivery feature communicating between the container and an outlet of the delivery feature, for transfer of said fluid to the smoking article, wherein the delivery feature comprises at least in part a tube of significantly lesser diameter than the diameter of the smoking article, and the combination of container and delivery feature provides for placement of a substantially definable quantity of said fluid at a predetermined location within the smoking article.

In a particular embodiment, the delivery feature of the device according to the invention comprises an injection needle. In an especially favoured construction, the injection needle is adapted for lateral injection of said fluid through a side wall of the filter. The fluid for providing the wetted impact barrier may contain syrup type solutions such as corn syrups, honey, glycol, petroleum jelly, mineral oil, maple syrup; any sugar based liquids such as all fruit syrups, gurgum; all food grade oils such as soybean oil, corn oil, pectin, and all types of food grade gels. These fluids act, when applied physically by the user to a filter, primarily as a barrier. When the cigarette is smoked, the barrier is impacted on by the smoke, resulting in cooling of the smoke and condensation of volatile compounds. Because a syrupy type fluid is prone to dry out or harden within a narrow diameter passage such as an injection needle, in a preferred structure, the needle is a disposable unit mountable on the container for one-trip use. The one-trip needle may be either screwed onto or pushed onto an outlet portion of the container, which may be the neck of a small bottle.

Control of delivery of fluid from the container may be facilitated by the construction of the container. Preferably, in the device according to the invention, at least a portion of a wall of the container is resilient and/or pliable. This feature enables the user to control the delivery of fluid into the needle and ultimately into the filter tip by applying suitable pressure on the exterior sides of the container in a regulated manner.

A further embodiment of the device comprises at least one injection needle. The needle is selected to be of a suitable length and may be mounted on a syringe-type arrangement, preferably with gradations for metering purposes, so that the needle may be inserted through the base of the cigarette, up through the tobacco, and the fluid released into the base of the filter. This needle may also have a sheath extending alongside it, substantially the same in internal diameter as the external diameter of the cigarette. This arrangement allows the cigarette to be pushed down over the needle and injection action to take place, either independently using a syringe arrangement as in the previously described embodiment, or by virtue of the cigarette engaging some type of spring-biased fluid release feature. Advantages of these embodiments are the accurate placing of the fluid in the diametrical centre of the cigarette and the location of the fluid definitively and precisely at the base of the filter adjoining the tobacco by selection of an appropriate length of needle. Needles of different length may be provided for different sizes of cigarette.

Thus the or each injection needle may be of sufficient axial extent for insertion from an end region of an elongate smoking article to extend axially within said smoking article to a region of said filter in the vicinity of a filter to tobacco boundary. The needle may be of sufficient axial extent for insertion from the tobacco end of the smoking article to extend into said region of the filter in the vicinity of the filter to tobacco boundary, or it may be of sufficient axial extent for insertion from the filter end of the smoking article to extend into said region of the filter in the vicinity of the filter to tobacco boundary. In either circumstance, stop means may be provided to delimit the extent of insertion of said injection needle.

A further embodiment allows for top injection of the fluid, and comprises a number of very narrow, hollow pins, projecting within a sheath, the sheath being substantially the same in internal diameter as the external diameter of the cigarette. The container for the fluid is mounted on this applicator device and a metering valve communicates with a fluid dispensing feature. This feature suitably comprises a piston, displaceable within a cylinder, the pins being mounted on and extending from the displaceable piston. The filter tip end of the cigarette is pushed against the piston, which is spring-loaded, so that when the filter is pushed against the pin mounting piston, there is a measured amount of fluid dispensed into the filter. The advantages of this embodiment are the precise metering of the fluid and the even distribution of the fluid across the diameter of the filter at its base.

Thus the device according to the invention may comprise a plurality of injection needles. The delivery feature may further comprise a piston and cylinder type unit, control of delivery being achieved by displacement of a piston or plunger within a cylinder of the unit. Said cylinder may be provided with an external sheath to engage over the exterior of at least a portion of an elongate smoking article during application of the device to the smoking article and may also be provided with gradation marks to facilitate the dispensing of a substantially definable quantity of said fluid.

The or each injection needle may extend from an end face of the cylinder, said end face defining a stop to delimit the extent of insertion of the injection needle(s) into a smoking article. Said piston or plunger may alternatively be spring-loaded and delivery of fluid is then achieved by engagement of an end face of the smoking article against said piston or plunger and displacement of the piston or plunger against the spring loading. In such an arrangement, the or each injection needle may thus extend directly from said piston or plunger, the face of the piston/plunger from which the needle(s) extend (s) defining a stop to delimit the extent of insertion of the injection needle(s) into a smoking article. A non-return valve may then be included for one-way flow of fluid from container to cylinder.

A further possibility allows for a single pin at the top end, which may have an end fluid discharge opening combined with side openings, or side openings only. This means that the fluid injected through the needle is discharged out sideways at the end of the injection pin.

A diversity of further embodiments are also feasible, combining the various features described above in a multiplicity of ways, viz. single or multiple needles, syringe or spring-loaded dispensers, and accurate metering.

The device according to the invention allows a distributed zone of impact barrier fluid to be formed. The fluid forms a blocking zone in the filter, trapping the tar and nicotine formed upon combustion.

The device of the present invention allows the fluid forming the wet impact barrier to be injected into the filter-tip at a location spaced from the end of the cigarette which the smoker puts in the mouth. The introduction of fluid at this position ensures that the fluid will not come into contact with the user's lips, thereby decreasing the chance of the user tasting the fluid. In use, the device of the present invention enables the insertion of fluid into the filter without causing lateral crushing of the filter material. This manner of insertion ensures that there is less damage to the fibrous structure of the filter as compared with that of devices of the prior art.

In the device according to the invention, the blocking fluid may comprise for example a corn syrup base, sodium benzoate, potassium sorbate, citric acid, water and colouring. The composition is such that it may be consumed as a food. It is not a drug composition and therefore use thereof has no risks or side-effects if inadvertently ingested.

Use of the device according to the invention has shown over 97% reduction of tars and nicotine delivery from a normal filtered cigarette when 3 drops of fluid are used. Use of the device according to the invention results in a reduced amount of nicotine reaching the lungs. The smoker is thus gradually "weaned" off the nicotine and is eventually able to give up smoking.

The invention also encompasses a kit for providing a distributed zone of fluid in a filter of a smoking article comprising:

(a) a container for a fluid which forms a wet impact barrier when inserted into a smoking article, and (b) a multiplicity of disposable delivery features for communicating between the container and an outlet of the delivery feature, for transfer of said fluid to the smoking article, each disposable delivery feature comprising at least in part a tube of significantly lesser diameter than the diameter of the smoking article and being mountable on the container for one-trip use for placement of a substantially definable quantity of said fluid at a pre-determined location within the smoking article.

This aspect of the invention is especially suited to the circumstance where the fluid to be injected is a syrupy or hardened substance, for injection of which a one-trip or disposable delivery feature or injection needle is especially suited.

BRIEF DESCRIPTION OF THE DRAWINGS

The invention will be further described by reference to the accompanying drawings in which.

DETAILED DESCRIPTION OF THE DRAWINGS

FIGS. 1 to 4 illustrate the device of the prior art, WO 92/14371 and have been discussed previously hereinbefore.

Figure 1:
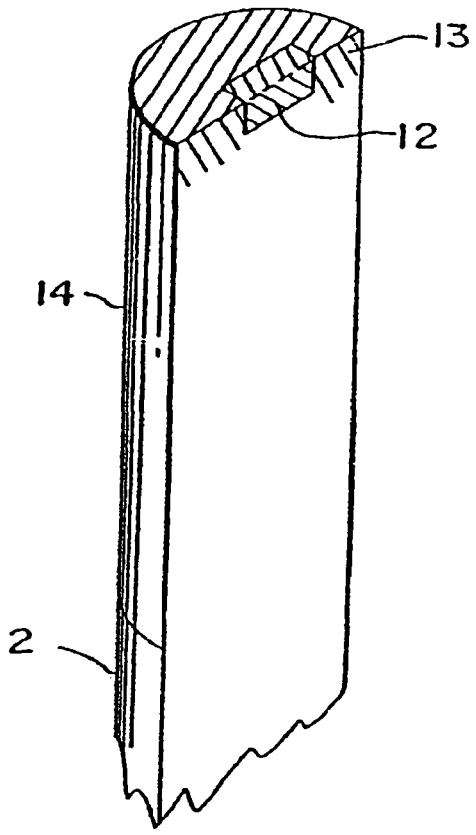
Fig. 1 (Prior Art)
FIG. 1 shows a partial cross sectional view of a cigarette having a square-shaped wellular recess (prior art WO 92/14371)
Figure 2:
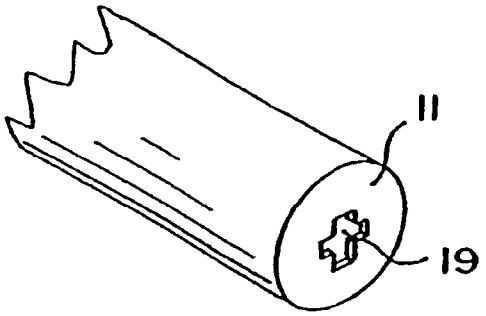
Fig. 2 (Prior Art)
FIG. 2 shows a top end view of a cigarette having a cross shaped recess configuration (prior art WO 92/14371)
Figure 3:
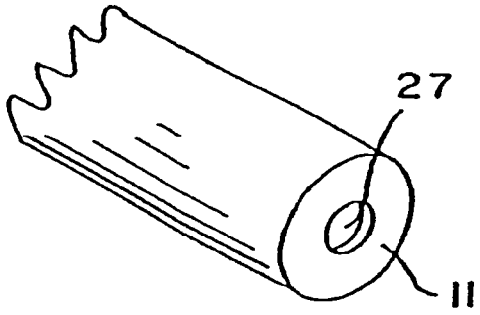
Fig. 3 (Prior Art)
FIG. 3 shows a top end view of a cigarette having an oval shaped recess configuration (prior art WO 92/14371)
Figure 4:
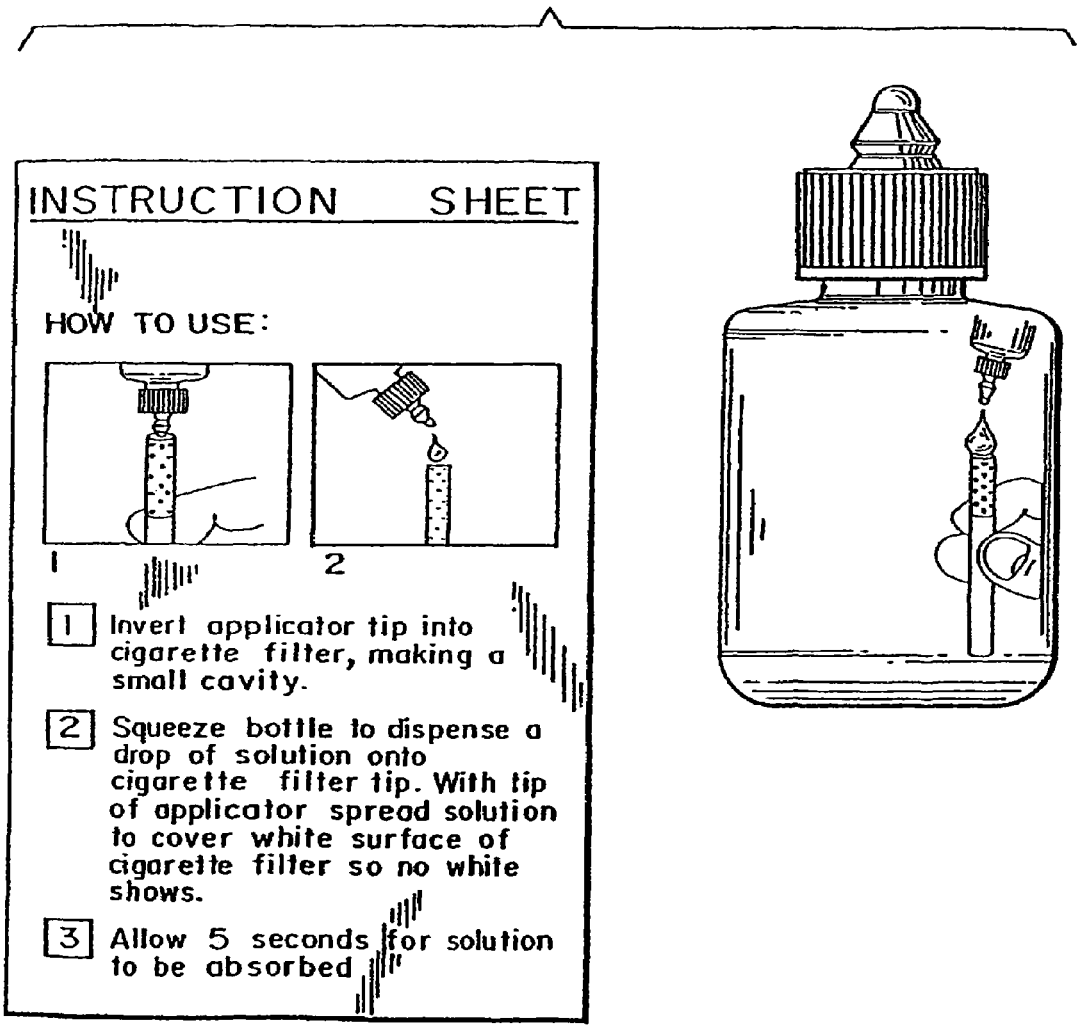
Fig. 4 (Prior Art)
FIG. 4 shows a depiction of the components of the kit disclosed in WO 92/14731.
Figure 6:
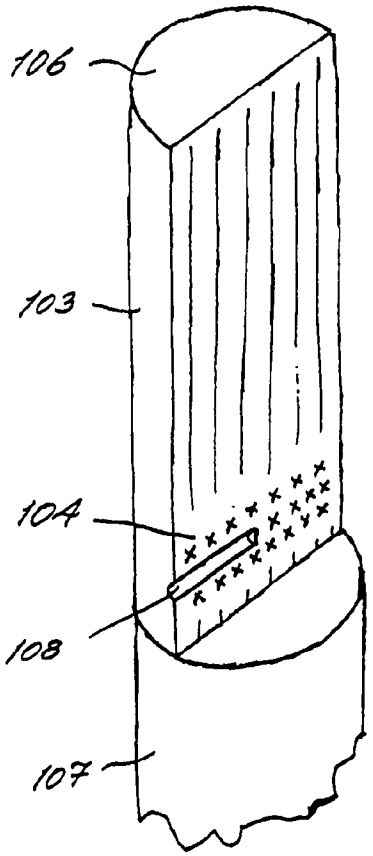
FIG. 6 shows a section through the region of the cigarette where the barrier is injected.
Figure 5:
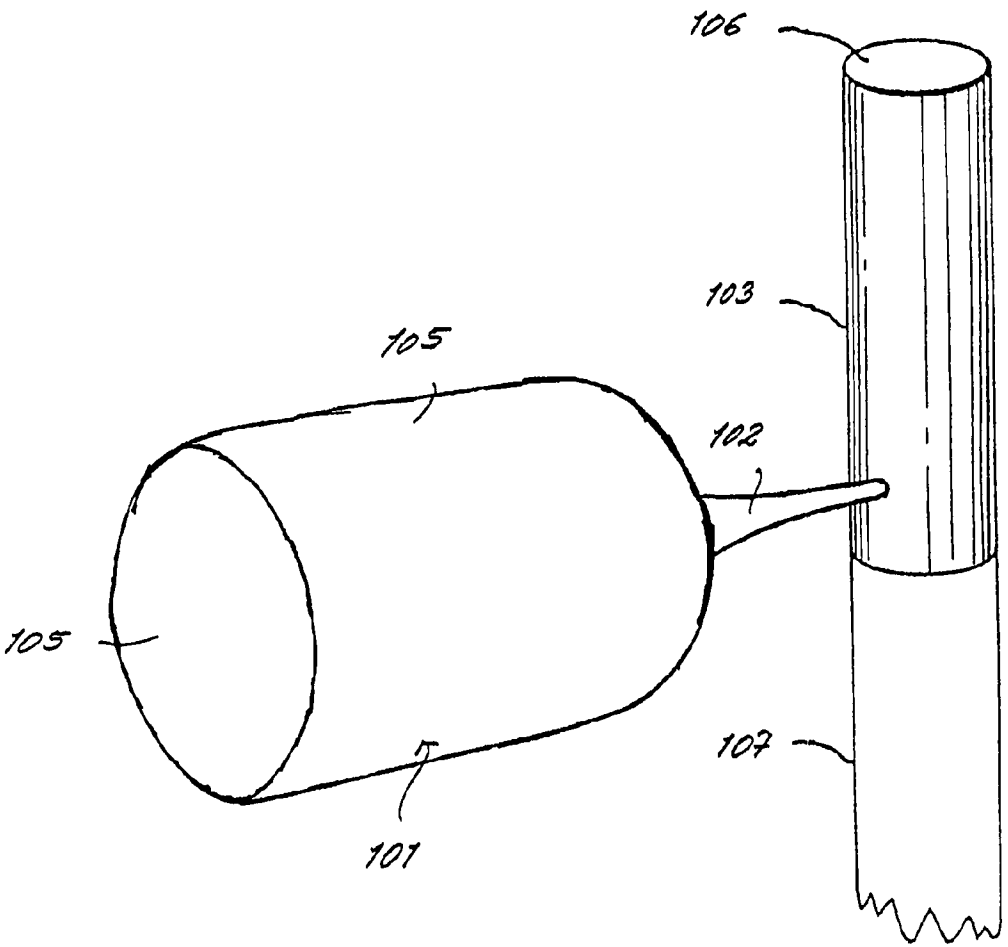
FIG. 5 is a pictorial representation of an injection type arrangement according to the present invention for introducing the barrier-forming fluid into the filter-tip.

Referring to FIG. 5, the device according to the invention comprises a container 101 for holding a wet impact barrier forming fluid. The container 101 is provided with a delivery feature comprising an injection needle 102. The injection needle 102 may be inserted into the side wall of a filter tip 103 at a suitable location for transfer of the fluid into the filter tip 103 so as to form a wet impact barrier 104 (FIG. 6). The wall portions 105 of the container 101 are resilient/pliable, thereby allowing for expulsion of fluid contained therein and control of the quantity of fluid delivered by applying pressure to the exterior of the container 101. The extent of the pressure applied regulates the amount of fluid discharged, the rate of discharge and the quantity ejected into the filter-tip 103.

The injection type arrangement of the present invention thus allows the barrier-forming fluid to be introduced laterally into the filter-tip 103 at a location spaced from the end 106 of the cigarette 107 which the smoker puts in the mouth. The fluid is introduced at a location sufficiently spaced from the mouth end 106 of the cigarette 107 so that the wet barrier is not tasted by the smoker.

FIG. 6 shows an enlarged view of the filter 103 of a cigarette 107, in section in the region of the filter 103 where the barrier fluid is injected. Reference 108 indicates the aperture formed by the needle 102 in the side wall of the filter tip 103 following injection of the barrier-forming fluid. The fluid, when injected, distributes itself through the filter-tip medium 103. The shading designated by reference 104 indicates the region where the barrier is located when said fluid has distributed itself. The fluid disperses through the material of the filter 103, forming a viscous barrier which traps the tar and nicotine produced by combustion.

The injection needle 102 may be provided as a disposable unit for use in particular where the fluid is a sugary or syrupy type substance, prone to hardening within a needle feature following use, unless the needle is immediately rinsed out. Needle 102 is provided in a manner which allows it to be screwed onto a neck portion of the bottle 101 or pushed onto an opening at one end of the container. The disposable needle 102 is suitable for one-use or one-trip only and is discarded following the dispensing of the required amount of inhibiting fluid. In a kit for application of the invention, a single container 101 is provided with a multiplicity of attachments or needle fittings 102, mounted for example on a card backing. An individual needle 102 is detached from the card and applied to the neck of the container 101 either by screwing on or push-on, at the time of use. Each syringe portion or needle or tube 102 forms a bridge between the interior of the bottle and the interior of the filter when an injection operation is to be carried out. The needle is suitable for just one delivery of a quantity of fluid for insertion into the cigarette. Following use, it is removed from the container 101 and discarded. A closure lid or cap is then reapplied to the container 101, to maintain the contents in good order. The syringe or needle feature 102 which is disposable is provided at relatively low cost as part of a multiple set of one-trip needles embodied in a kit which also includes the fluid container 101 and the fluid held within the container. In particular, a large number of needles can be mounted on a card for detachment as required at the time of use.

Metering of an appropriate amount of barrier-forming fluid is of significance in the system according to the invention. The amount injected may comprise 1, 2 or 3 drops depending on the inhibiting effect to be developed. The embodiment described with respect to FIGS. 5 & 6 provides only limited control over the quantity injected, because squeezing the sides of the pliable container 101 is to an extent a subjective action and limits the extent of control over the size of each drop dispensed.

Figure 7:
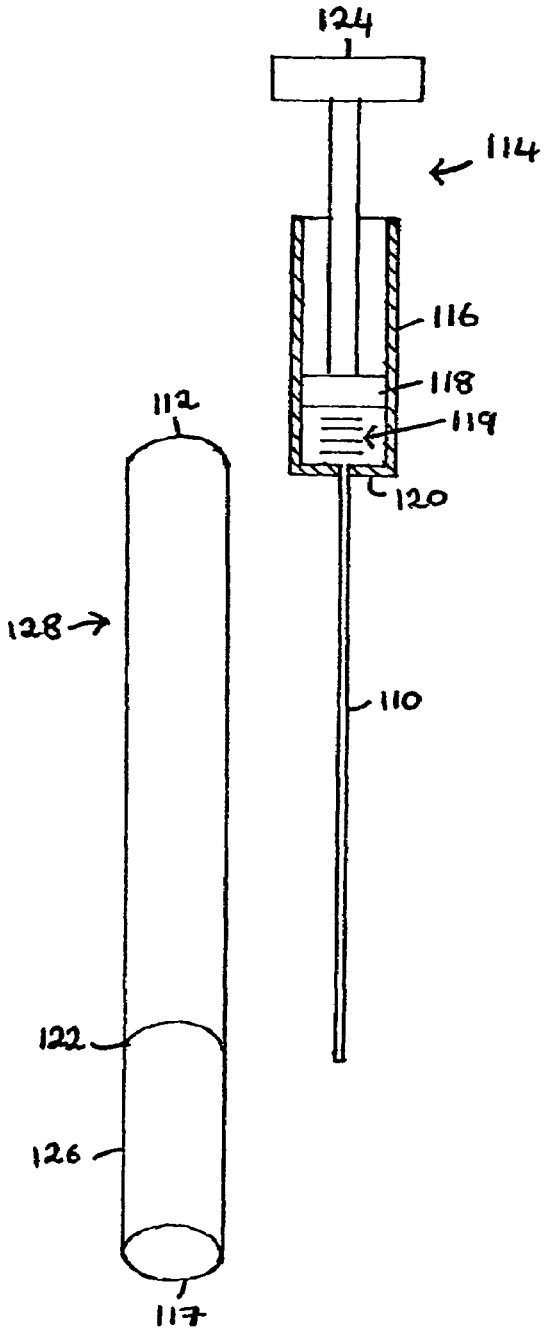
FIG. 7 shows a diagrammatic side sectional view of an alternative injection type arrangement according to the present invention for introducing a barrier-forming inhibiting fluid into the filter tip of a cigarette.

An alternative embodiment illustrated in FIG. 7 provides a number of advantages. As illustrated in FIG. 7, the injection arrangement comprises a syringe type dispenser 114 having a cylinder 116 and a plunger or piston 118 displaceable within the cylinder. An elongate dispensing needle 110 extends from the base of the cylinder 120 remote from the plunger actuating portion or handle 124 and is of sufficient length so that when inserted from the tobacco end 112 of a cigarette 128, the open end of the injection needle is located substantially at the base 122 of the filter portion 126 when the end face 112 of the cigarette 128 abuts the end face of the syringe 120 from which the needle extends. Injection may then take place by the user pushing in the actuating or handle end 124 of the plunger 118. Gradation marks 119 may be provided on the syringe arrangement, so that a precise amount of fluid may be dispensed by appropriately controlling the travel of the plunger 118. To facilitate this aspect of the dispensing arrangement, the cylindrical body of the syringe 116 may be transparent or provided with an appropriate window region. Other manners of gradation are however not excluded.

Since the needle 110 is of suitable length, injection of the fluid then takes place into the base of the filter 122. In common with the arrangement of FIGS. 5 and 6, this placement of the fluid serves to minimise any taste from the fluid becoming apparent to the user during smoking. As compared with the arrangement of FIGS. 5 & 6 however, the fluid is contained entirely inside the cigarette 128 and its filter portion 126. There is no possibility of any fluid coming onto the exterior of the filter 126, because there is no puncture in the side-wall of the filter. Selection of an appropriate length of needle 110 enables location of the fluid definitively and precisely at the base of the filter 122. The applicator or dispenser unit 114 has a potentially indefinite life span. The syringe-type unit 114 may be provided with needles 110 of different lengths to suit different sizes of cigarette 128. An appropriate length of needle 110 may be attached to the syringe 114 depending on the size of the cigarette 128.

Figure 8:
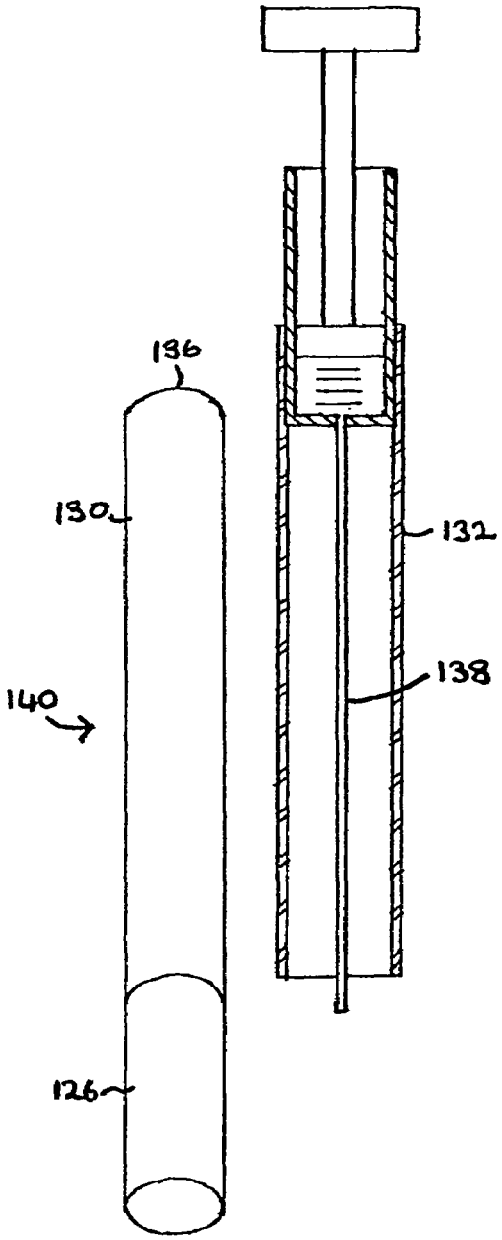
FIG. 8 shows a modified version of the embodiment of FIG. 7.

In order to improve the precise substantially axial alignment of the needle 110 up through the elongate length of the tobacco portion 130 of a cigarette, the further arrangement of FIG. 8 may be provided. In this case, a sheath 132 extends from the syringe, the sheath 132 being substantially the same in its internal diameter as the external diameter of the cigarette 130. The injector needle 138 is aligned substantially centrally within the sheath 132, i.e. coaxially with the cylindrical wall of the sheath 132. Thus in order to use the device in this embodiment, the cigarette 140 is pushed down inside the sheath 132 and over the needle 138. The needle 138 is thus constrained to assume an axial disposition within the cigarette 140, coaxial with the axis of the cigarette. Injection action may then take place in precisely the manner described in connection with FIG. 7, with appropriate metering. Other alternative metering and dispensing features may also be provided in alternative constructions. Exact central placement of the inhibiting fluid within the filter tip 126 is facilitated by the centralising action of the sheath 132.

Figure 9:
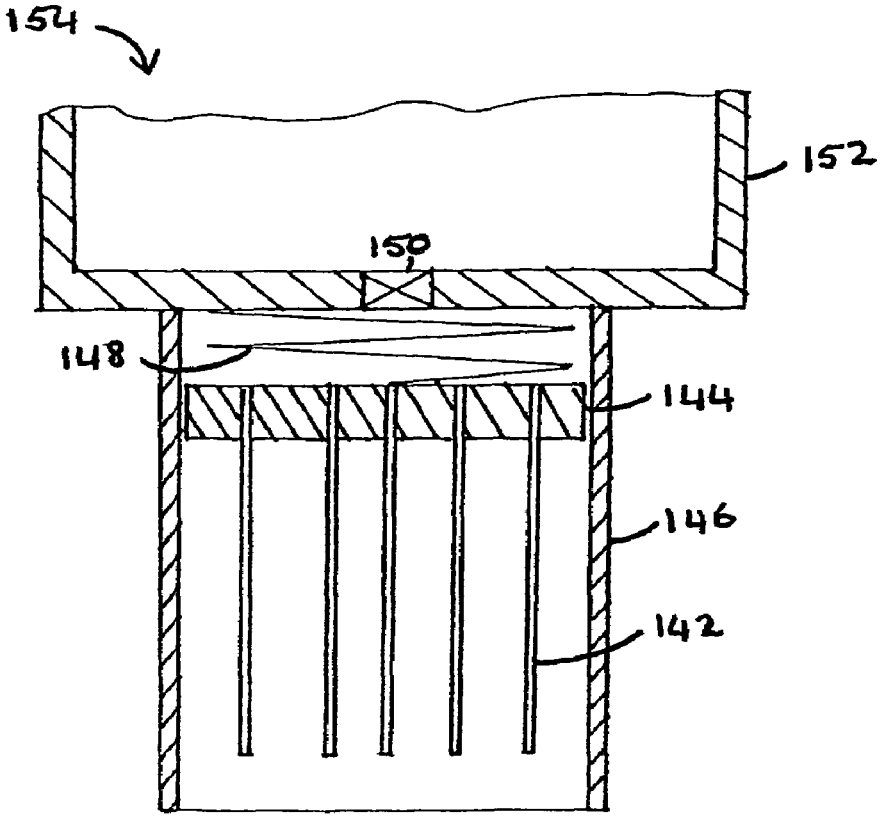
FIG. 9 shows yet another embodiment in side sectional view of an injection type arrangement according to the present invention for introducing a barrier-forming fluid into the filter tip of a cigarette.

In the variant of FIG. 9, the possibility of top injection, through the filter tip itself from the end of the cigarette which is put in the mouth, is provided. An arrangement similar to an optic for dispensing a measured amount of an alcoholic drink is proposed. A number of hollow pins 142 of very narrow diameter extend from a piston 144, which is biased into a downward disposition within a sleeve or sheath 146 defining a cylinder, by means of an internal spring 148. When the piston 144 is biased into its extended position, a non-return valve 150 allows entry of the inhibiting fluid from a container 152 communicating with the internal space above the piston 144, within the cylinder-form sheath 146.

To insert the fluid, the filter tip of the cigarette is inserted into the sheath 146 and the cigarette pushed up. The hollow pins 142 penetrate the filter tip to a location close to the filter/tobacco boundary. When the end face of the filter presses against the piston 144 portion of the unit, the piston 144 is displaced against the force of spring 148. The space within the cylinder 146 is thus reduced, and a measured amount of fluid is forced out of the cylinder 146, to be delivered through the dispensing needles 142 to the interior of the filter tip adjacent to the tobacco. The arrangement may be such that each displacement of the piston 144 of the applicator unit 154 delivers one drop of the inhibiting fluid. Multiple actions enable the dispensing of larger quantities of fluid in a precisely measured quantity. Advantages of the arrangement are precise metering and also even distribution of the fluid across the filter tip within its diameter.

The single pin arrangement of FIGS. 7 & 8 may be applied in the spring biased construction of FIG. 9. Likewise, more than one needle may be used in the arrangement of FIGS. 7 & 8, although this would most likely not be a preferred option for this construction. The arrangement of FIGS. 7 & 8 may however also function with a spring biased metered piston arrangement similar to that shown in FIG. 9, in a vertical orientation with the needle 110 or 138 directed downwardly.

Figure 10:
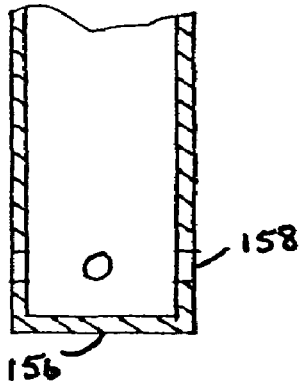
FIG. 10 shows a first embodiment of injector pin, in enlarged sectional representation.

The active end of the injector needle, whether in the single pin arrangement or in a multi-pin structure, may also take a diversity of forms. It may for example be a simple open-ended needle. Alternatively, as shown in FIG. 10, it may have a blanked-off end 156 with distribution of fluid taking place through lateral apertures 158 in the side-walls of the needle.

Figure 11:
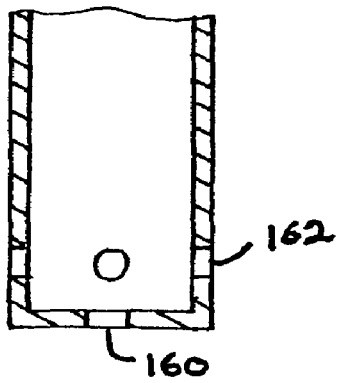
FIG. 11 shows an alternative embodiment of injector pin, again in side sectional view and greatly enlarged.

A further arrangement is shown in FIG. 11, in which the end wall 156 is provided with an end face aperture 160 of small diameter, while radially-oriented lateral apertures 162 are also provided in the side wall. The needle end arrangements of FIGS. 10 & 11 ensure an even and continuous distribution of the inhibiting liquid across a substantially planar region substantially defined within the end of the filter tip adjacent to the tobacco.

Thus in summary, FIG. 7 illustrates another embodiment of the device wherein injection needle 110 may be inserted into the tobacco end 112 of a cigarette so as to form a wet impact barrier. The container 114 is calibrated thereby allowing for control of the quantity of fluid delivered. This arrangement allows the barrier forming fluid to be introduced into the base of the filter 122. The fluid is introduced sufficiently spaced from the mouth end 117 of the cigarette so that the wet barrier is not tasted by the smoker.

FIG. 8 illustrates a similar arrangement where a sheath 132 extends up alongside the needle, substantially the same in internal diameter as the external diameter of the cigarette. This allows the cigarette 128 to be pushed down over the needle 110.

FIG. 9 shows an enlarged view of a top injector applicator where a number of pins 142 project within a sheath 146. The applicator in this form is pushed onto the filter end of the cigarette. The pins are mounted on a spring-loaded piston 144, so that when the filter is pushed against the pin mounting or piston 144, a measured amount of fluid is delivered. A metering valve 150 allows one-way flow of fluid from a storage container 152 to the dispensing piston of the applicator.

FIGS. 10 and 11 show further possibilities for top injection. FIG. 10 shows a pin with side openings 158 only whereas FIG. 11 shows a pin with an end opening 160 combined with side openings 162.

In all injector-type embodiments, injector needle diameter and other dimensions are matched to the flow and viscosity characteristic of the liquid. In the embodiments in which the injector needle or needles are downwardly directed, outflow of liquid may be curtailed except under piston action by sizing the needle parameters for capillary restraint of unwanted or uncontrolled discharge of liquid.

It will be further appreciated that where the characteristics of the liquid render it prone to solidification or hardening within a needle type injection feature, either a one-trip or disposable type needle may be used, or alternatively, it is necessary for the user to cleanse or flush out the needle immediately after use. In order therefore to maintain in good order an arrangement according to the invention intended for repeated use, a maintenance step is required following each dispensing operation. It is necessary for the injection needle to be rinsed out where the fluid used has characteristics rendering it prone to clog the needle unless this flushing or rinsing step is completed.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A method of using a device for providing a tar and nicotine barrier in a filter of a smoking article, the method comprising:

providing a container of the device with a supply of viscous fluid which when placed in the filter of a smoking article forms a barrier therein which traps tar and nicotine within the filter;

placing a delivery feature of the device at a predetermined location within the filter that is sufficiently remote from a free end face of the smoking article to be put in the mouth so as to prevent the user from tasting the viscous fluid; and transferring the viscous fluid from the container to the filter through an outlet of the delivery feature that is in fluid communication with the container;

wherein the delivery feature comprises at least in part a single tube of significantly lesser diameter than a diameter of the smoking article;

wherein the transferring of the viscous fluid is performed via lateral injection through a side wall of the filter and wherein the delivery feature is readily replaceable after a one-time use.

2. The method as claimed in claim 1, wherein the viscous fluid comprises corn syrup.

3. The method as claimed in claim 2, wherein the transferring of the viscous fluid includes operating a metering valve of the device to precisely meter the amount of viscous fluid dispensed into the filter.

4. The method as claimed in claim 1, further comprising removing the delivery feature from the device after a one-time use.

5. The method as claimed in claim 1, wherein the transferring of the viscous fluid is performed using a plurality of delivery features provided on the device.

* * * * *